United States Patent [19]

Ceklovsky

[11] Patent Number: 4,924,239

[45] Date of Patent: May 8, 1990

[54] ANTENNA MOUNTING APPARATUS

[75] Inventor: Joseph P. Ceklovsky, Rome, N.Y.

[73] Assignee: The united States of America as represented by the Secretary of the Air Force, Washington, D.C.

[21] Appl. No.: 316,760

[22] Filed: Feb. 28, 1989

[51] Int. Cl.[5] ..... H01Q 1/12; H01Q 3/16

[52] U.S. Cl. ..... 343/882; 248/539

[58] Field of Search ..... 343/878, 880, 882, 840, 343/781 CA, 761, 757; 248/539, 278, 183, 230, 229

[56] References Cited

U.S. PATENT DOCUMENTS

| | | | |
|---|---|---|---|
| D. 275,197 | 8/1984 | Feagle | D14/86 |
| 2,585,579 | 2/1952 | Norden | 250/33.65 |
| 2,605,417 | 7/1952 | Andrews | 250/33.65 |
| 4,356,488 | 10/1982 | Pollard | 343/890 |
| 4,763,132 | 8/1988 | Juds et al. | 343/890 |
| 4,799,067 | 1/1989 | Tekip et al. | 343/890 |
| 4,819,006 | 4/1989 | Whitesides et al. | 343/880 |
| 4,819,007 | 4/1989 | Tezcan | 343/882 X |

FOREIGN PATENT DOCUMENTS

| | | | |
|---|---|---|---|
| 3127855 | 6/1983 | Fed. Rep. of Germany | 343/880 |
| 0181302 | 10/1983 | Japan | 343/880 |
| 0075103 | 4/1985 | Japan | 343/878 |
| 0136401 | 7/1985 | Japan | 343/878 |

*Primary Examiner*—Ramon S. Britts
*Assistant Examiner*—D. J. Hulseberg
*Attorney, Agent, or Firm*—Stanton E. Collier; Donald J. Singer

[57] ABSTRACT

The antenna mounting apparatus includes an equipment frame and a reflector mounting apparatus. The reflector mounting apparatus has both an elevation control and an azimuth control incorporated therein such that the apparatus has both strength and low weight.

8 Claims, 6 Drawing Sheets

ANTENNA MOUNTING APPARATUS

STATEMENT OF GOVERNMENT INTEREST

The invention described herein may be manufactured and used by or for the Government for governmental purposes without the payment of any royalty thereon.

BACKGROUND OF THE INVENTION

The present invention relates to microwave antenna devices, and, more particularly, to an adjustable microwave antenna mounting apparatus.

Line-of-sight microwave towers require a location significantly elevated from the surrounding structures and terrain to prevent reflection of the transmitted beams and to obtain farther distances. Such locations normally would include mountain tops, high buildings, and if these are not available, high towers. These locations are typically exposed to high winds.

The antenna should be mounted at these locations on an apparatus that can easily be attached to towers such as shown in U.S. Pat. Nos. 4,763,132 and 2,605,417 which are incorporated by reference. Although the general direction for pointing these antennae can be approximated by moving the whole mounting apparatus, optimum performance requires the ability to finely adjust the antenna pointing direction. This is especially critical when long distances are involved. This ability to finely adjust means that the apparatus must have joints that rotate. This ability clearly weakens the apparatus. One could try to counter this problem by providing a massive structure but this causes additional problems such as mounting the apparatus and the size of the tower needed to support the antenna apparatus.

Because antenna towers typically have more than one antenna, the mounting apparatus should be small in size and of low weight.

SUMMARY OF THE INVENTION

The present invention provides an adjustable microwave antenna mounting apparatus.

The mounting apparatus includes an equipment frame apparatus and a reflector mounting apparatus.

The equipment frame apparatus has a U-shaped frame with upper and lower mounting means which use U bolts to attach to a cylindrical tube that is, in turn, mounted to a tower. The vertical side of the equipment frame apparatus may include several shelves for the mounting of transmitter and receiver units. They may also be mounted on the horizontal sides of the frame. The frame, itself, may be made of U-shaped metal beams.

The reflector mounting apparatus includes a dish attachment plate, a feed horn attachment plate, an elevation control means, an azimuth control means, a supporting frame, and tower attachment means.

The dish attachment plate, the elevation and azimuth control means and the tower attachment means are all connected to the supporting frame. Each of the control means includes an adjustable rod and a locking bar to move the antennae dish in an appropriate direction.

It is therefore one object of the present invention to provide an adjustable antenna mounting apparatus.

It is another object of the present invention to provide a mounting apparatus having an equipment frame apparatus and a reflector mounting apparatus that can be mounted to a tower in close proximity to each other.

It is another object of the present invention to provide a reflector mounting apparatus having orthogonal adjustable means.

It is another object of the present invention to provide a reflector mounting apparatus being of small size, low weight, high strength, and easily adjustable.

DETAILED DESCRIPTION OF THE DRAWINGS

DETAILED DESCRIPTION OF THE PREFERRED EMBODIMENT

Figure 1:
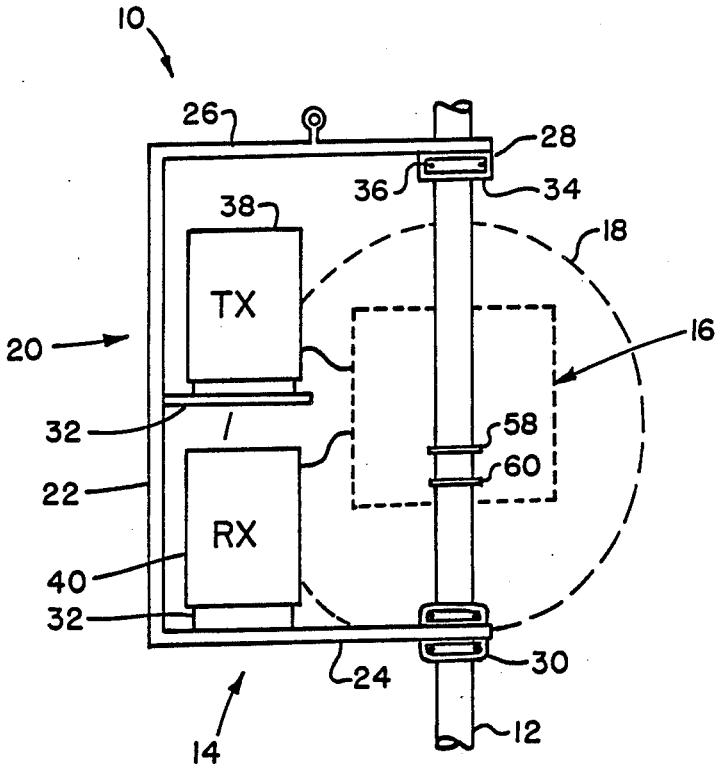
FIG. 1 illustrates the antenna mounting apparatus attached to a tubular member.

Referring to FIG. 1, an antenna mounting apparatus 10 is shown attached to a tubular member 12 that may be attached to a suitable structure such as a tower, not shown.

The antenna mounting apparatus 10 includes an equipment frame apparatus 14, a reflector mounting apparatus 16, shown in outline only and to be detailed hereinafter, and a reflector 18. Only one of each item is shown although additional items may be required. FIG. 1 illustrates one end of a microwave link.

The equipment frame apparatus 14 includes a frame 20 having a vertical side 22, a lower horizontal side 24, an upper horizontal side 26, an upper mounting means 28 and a lower mounting means 30, and a plurality of equipment shelves 32 being mounted upon frame 20.

The frame 20 may be constructed of standard U-shaped metal beams. The upper mounting means 28 includes a pipe clamp 34 which may be bolted or welded to the frame 20 and at least one U-bolt 36. The lower mounting means 30 is similarly constructed. The shelve 32 may be bolted or welded to the frame 30; bolting may be preferred because of changes in equipment mounted thereon. A transmitter 38 and a receiver 40 are shown mounted thereon.

Figure 2:
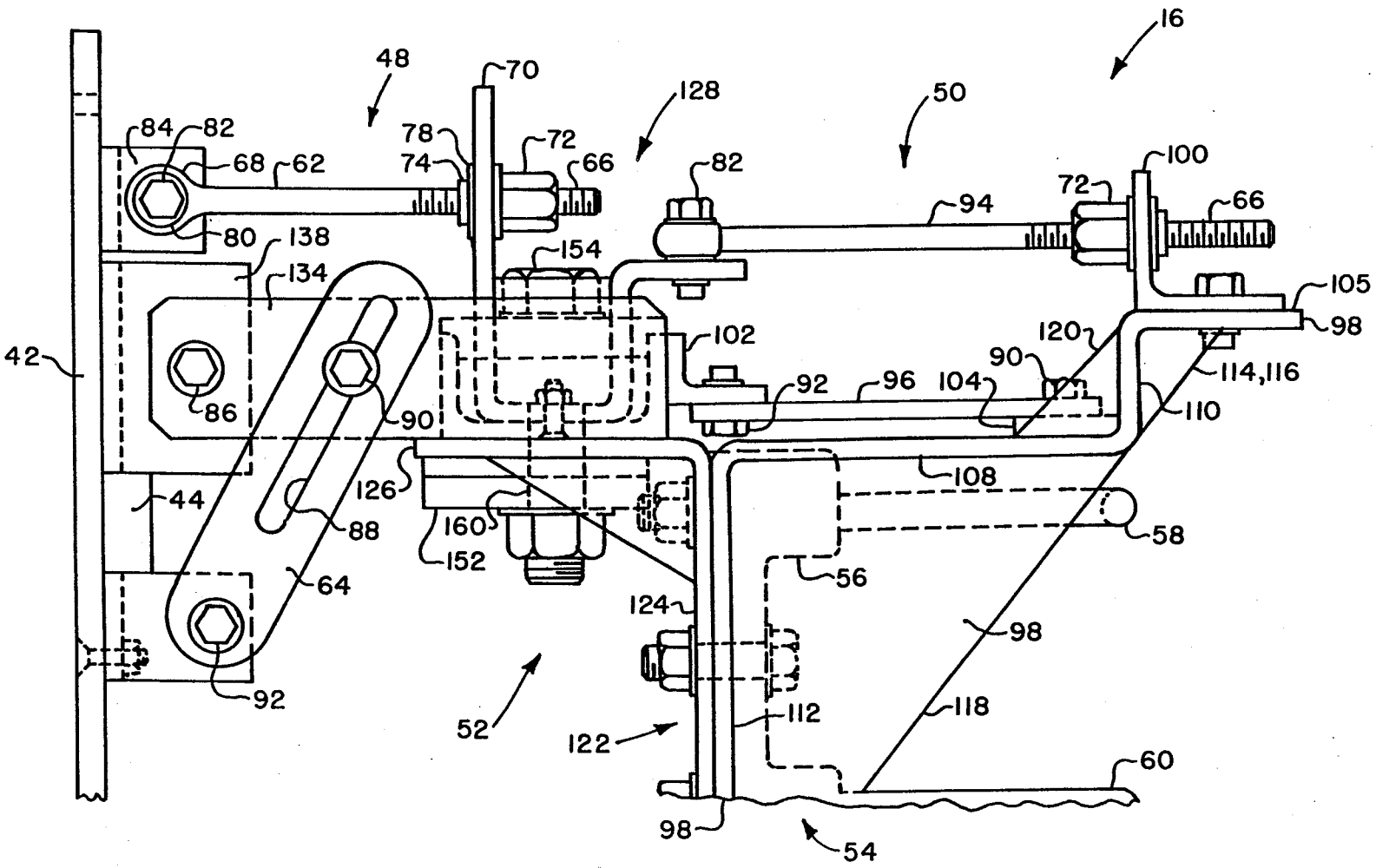
FIG. 2 illustrates by side views the reflector mounting apparatus.

FIG. 2 illustrates the reflector mounting apparatus 16.

Figure 7:
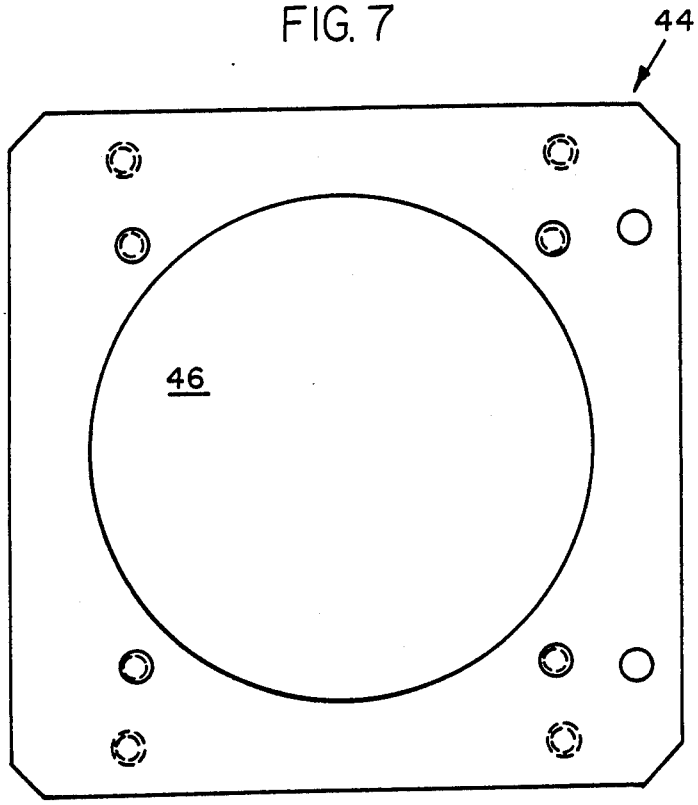
FIG. 7 illustrates the feed horn attachment plate.

The reflector 18, FIG. 1, is mounted to a dish attachment plate 42. A feed horn attachment plate 44, also shown in FIG. 7, is bolted to plate 42. A hole 46 therethrough accommodates the necessary feed horn apparatus not shown.

The material of the reflector mounting apparatus 16 may be ¼ inch aluminum plate where appropriate. Other types of materials are appropriate considering strength and corrosion resistance.

The main components of the reflector mounting apparatus 16 are an elevation control means 48, an azimuth control means 50, and a supporting frame 52. A tower attachment means 54 includes a pipe clamp 56 with two U-bolts 58 and 60 which are shown in FIG. 1.

Figure 5:
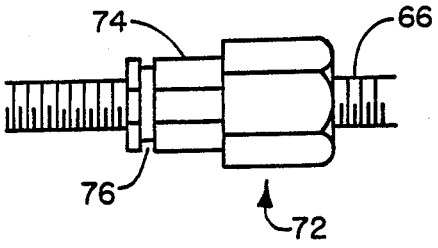
FIG. 5 illustrates an adjustable nut.

The elevation control means 48 includes an adjustable rod 62 with a locking bar 64. The adjustable rod 62 has a threaded end 66 and a ball end 68. The threaded end 66 is inserted through a vertical hole in a control means bracket 70. An adjustable nut 72, also FIG. 5, has a cylindrical sleeve 74 that fits closely within the vertical hole in the control means bracket 70. A channel 76 in sleeve 74 allows a C-clip retainer 78, FIG. 1, to be placed thereon so that adjustable nut 72 can rotate within the hole and remains thereon while adjustment occurs. The ball end 68 of rod 62 has a bearing 80 therein such that a bolt 82 is attached to a right angle bracket 84 by means of a nut plate, not shown.

Movement of adjustable nut 72 causes dish attachment plate 42 to rotate about a pivot bolt 86, only one shown of two.

Figure 8:
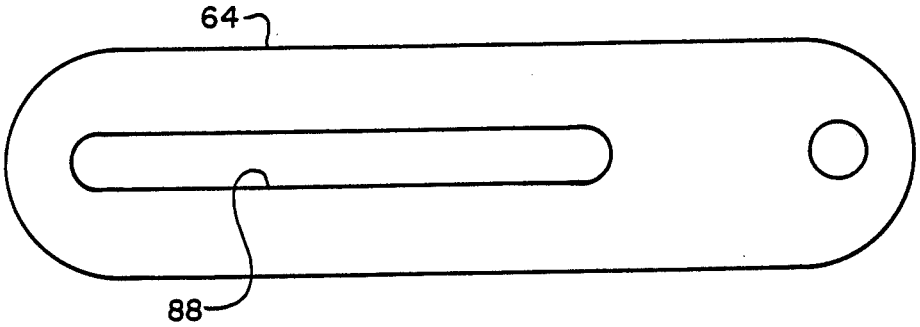
FIG. 8 illustrates a locking bar for the direction control means.

Once the correct elevation is obtained, the locking bar 64, FIG. 8, is bolted down by bolts 90 and 92. A slot 88 in locking bar 64 allows movement of the locking bar 64 when plate 42 is moved in the vertical plane. Only one of two locking bars 64 is shown.

Figure 3:
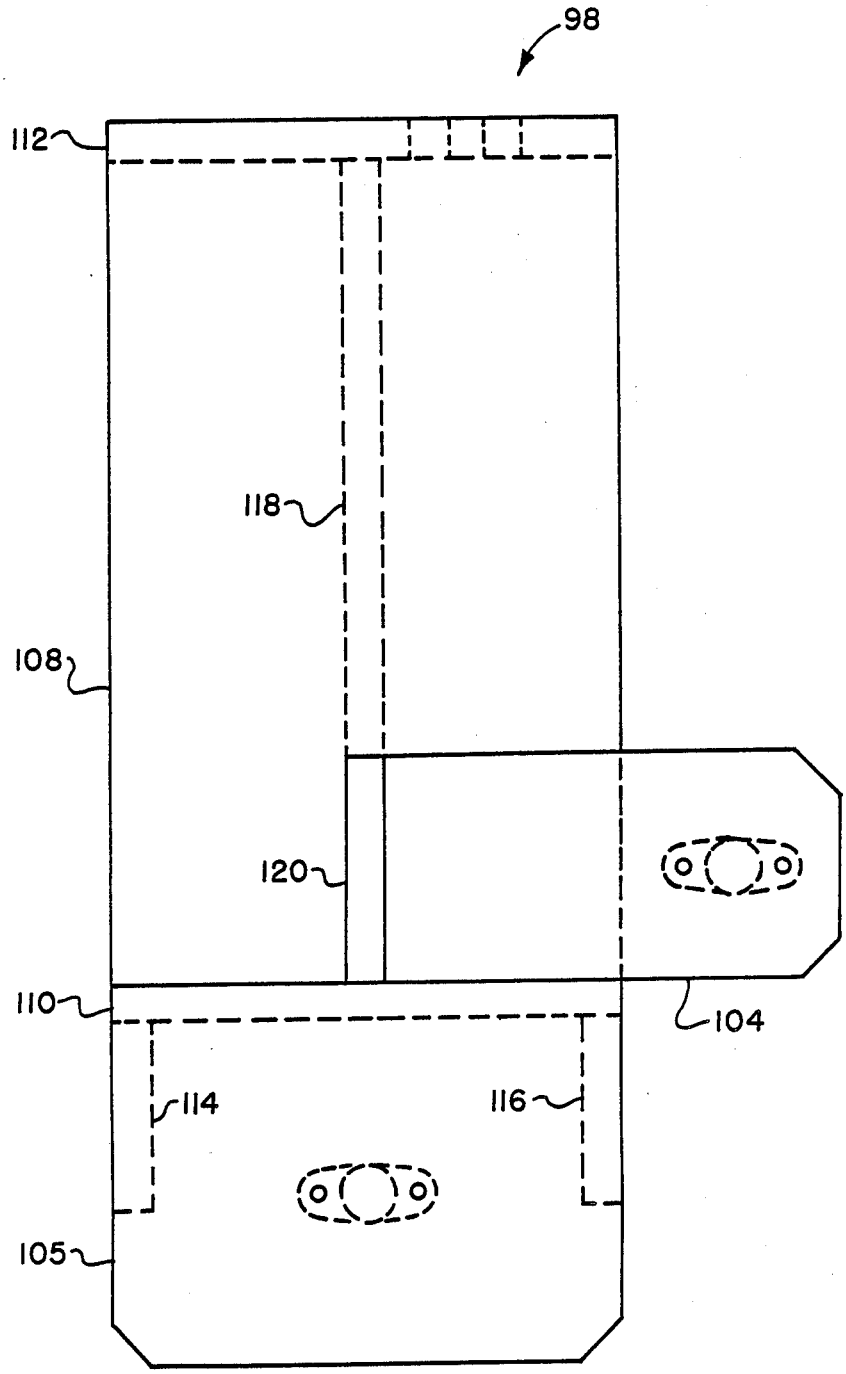
FIG. 3 illustrates by top view the azimuth support bracket.

The azimuth control means 50 includes an adjustable azimuth rod 94, an azimuth locking bar 96, an azimuth support bracket 98, also FIG. 3, and right angle brackets 100 and 102.

Adjustable rod 94 and locking bar 96 are of similar construction as those in the elevation control means 48 and similar items are so numbered. The azimuth control means 50 and the elevation control means 48 are located on the side of mounting apparatus 16 so as not to interfere with the tubular member 12.

The azimuth support bracket 98 is shown by side view in FIG. 2 and by top view in FIG. 3. The azimuth support bracket 98 is bolted to the supporting frame 52 to be detailed later.

The right angle bracket 100 is bolted to an upper support 105. The azimuth locking bar 96 is bolted to the right angle bracket 102 and to a horizontal support bracket 104 that is welded to a lower support 108. The upper support 105 is connected to the lower support 108 by an upper vertical support 110. The lower support 108 is connected to a lower vertical support 112. Angle brackets 114, 116, 118 and 120 provide necessary strength to the azimuth support bracket 98.

Figure 4A:
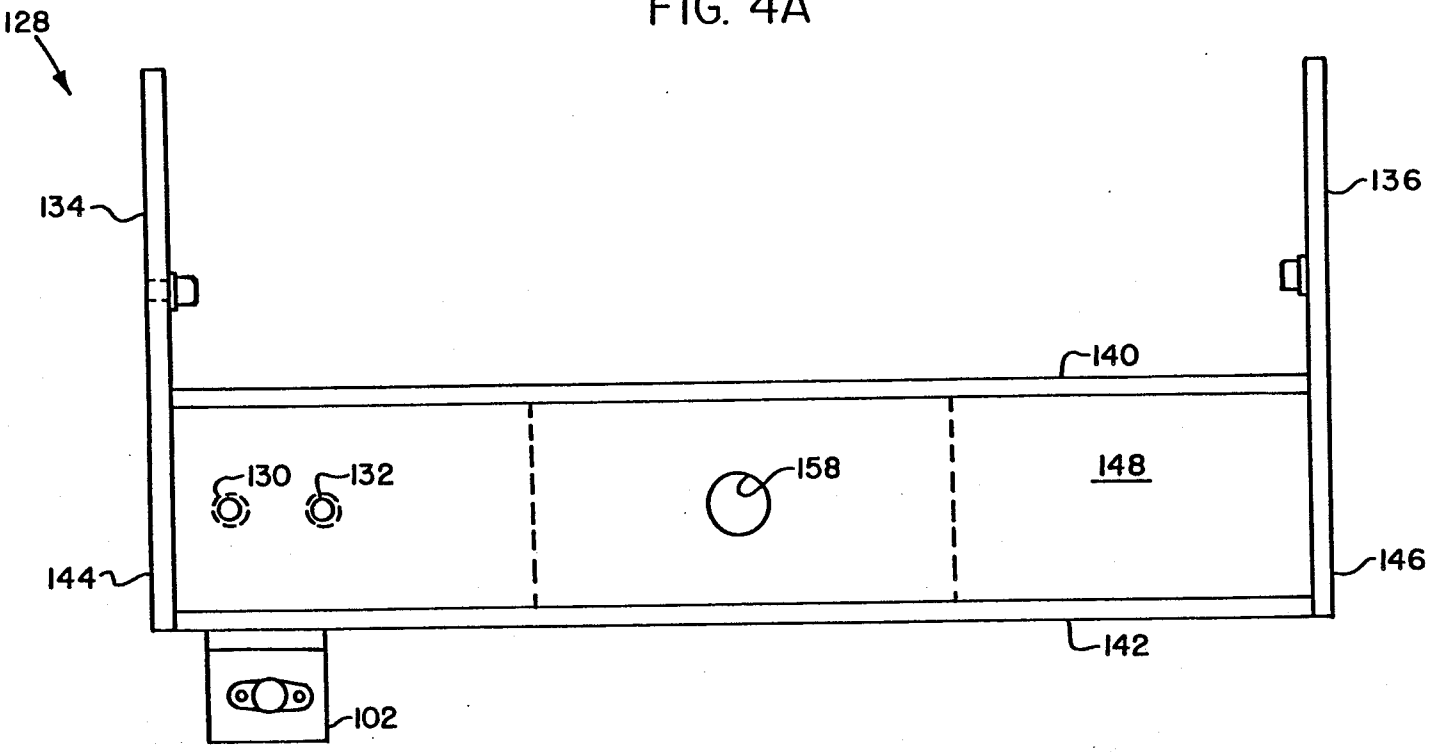
FIG. 4A illustrates by top view the upper supporting frame.

The supporting frame 52 includes a lower supporting frame 122 and an upper supporting frame 128, also FIG. 4A.

The lower supporting frame 122 includes a vertical frame 124 and a horizontal frame 126 with appropriate angle brackets welded thereon.

Bolted to and being rotatable on the horizontal frame 126 is the upper supporting frame 128, FIG. 4A being a top view.

Figure 6A:
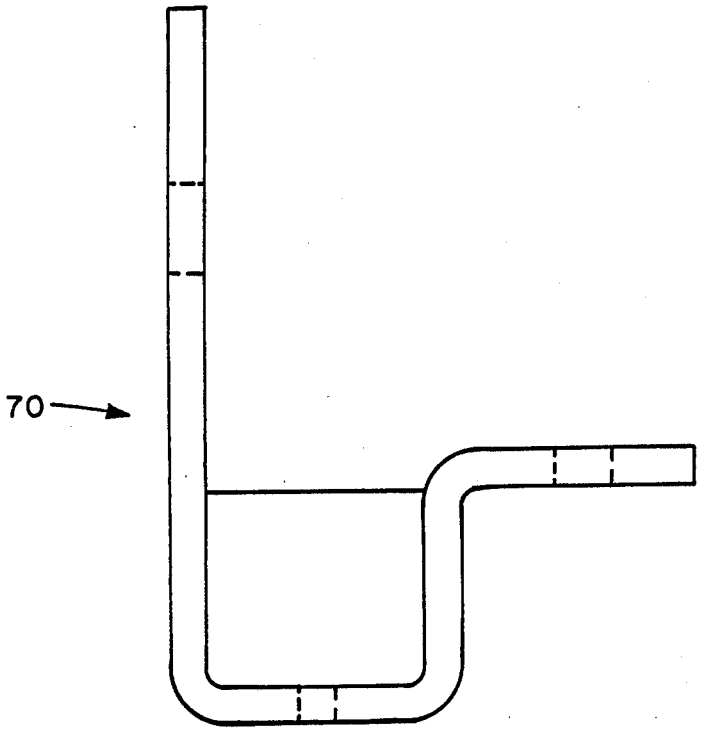
FIG. 6A illustrates by side view the bracket device between the upper supporting frame and direction control means.
Figure 6B:
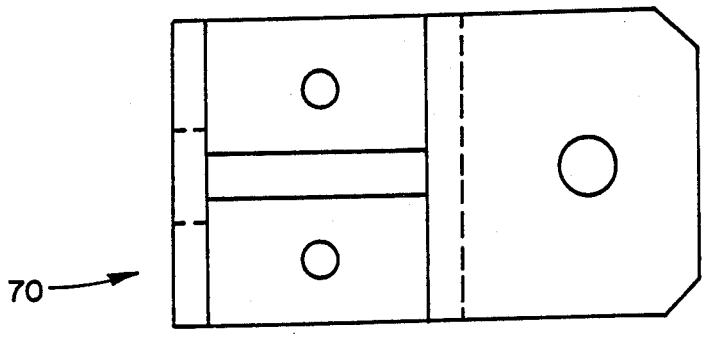
FIG. 6B is a top view of FIG. 6A.

A bracket 70, FIGS. 2, 6A and 6B, is bolted, through holes 130 and 132, into the left side of the upper supporting frame 128.

In FIG. 4A, the upper supporting frame 128 has a left support arm 134 and a right support arm 136. In FIG. 2, the left support arm 134 is bolted by the pivot bolt 86 to a right angle bracket 138 that is bolted to the plate 42, similarly to the right support arm 136.

In FIG. 4A, the upper supporting frame 128 has a front wall 140, a back wall 142, a left wall 144, a right wall 146 and a bottom 148. In FIG. 4B, a cover plate 150 fits partially over walls 140 and 142 of frame 128 in FIG. 4A.

The cover plate 150 extends to the left until it abuts the control means bracket 70 which is bolted to the bottom 148 of frame 128.

Figure 4C:
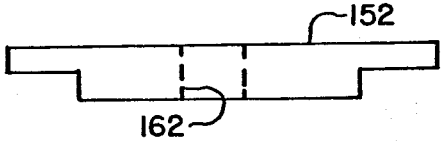
FIG. 4C illustrates by side view the reinforcing plate of the supporting frame.
Figure 4B:
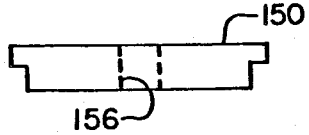
FIG. 4B illustrates by side view the cover plate of the upper supporting frame.

A reinforcing plate 152, FIG. 4C, is placed under the horizontal frame 126 within the dotted lines of FIG. 4A.

A main bolt 154, FIG. 2, is inserted through a hole 156 of the cover plate 150, FIG. 4B, through a hole 158 at the bottom 148, through a hole 160 of the horizontal support 126, and through a hole 162 of the reinforcing plate 152, FIG. 4C.

In operation, the adjustable rods 62 and 94, for elevation and azimuth, are appropriately adjusted by turning adjustable nuts 72. Upon reaching the correct setting the pivot bolts 86, the bolts of the elevation locking bars 64, the bolts of the azimuth locking bar 96 and the main bolt 154 are all secured.

Clearly, many modifications and variations of the present invention are possible in light of the above teachings and it is therefore understood, that within the inventive scope of the inventive concept, the invention may be practiced otherwise than specifically claimed.

What is claimed is:

1. An antenna mounting apparatus, said antenna mounting apparatus comprising:

an equipment frame apparatus, said equipment frame apparatus holding appropriate electronics in close proximity to at least one antenna, said equipment frame apparatus being attached to a stationary object; and at least one reflector mounting apparatus, said reflector mounting apparatus being adjustable in two orthogonal axes and reflector mounting apparatus being attached to the stationary object, and said electronics being directly linked in communication with a reflector mounted on said reflector mounting apparatus, said reflector mounting apparatus further comprising;

a dish attachment plate, said dish attachment plate having a central opening therein, said dish attachment plate having at least two brackets thereon;

a feed horn attachment plate, said feed horn attachment plate having a central opening therein, said feed horn attachment plate being attached to said dish attachment plate;

an elevation control means, said elevation control means adjustably connected to said dish attachment plate;

a supporting frame, said supporting frame adjustably connected to said elevation control means and to said dish attachment plate;

an azimuth control means, said azimuth control means, adjustably connected to said supporting frame; and attachment means, said attachment means connected to said supporting frame and attachable to the stationary object.

2. An antenna mounting apparatus as defined in claim 1 wherein said elevation control means further comprises:

a first bracket, said first bracket fixedly attached to said dish attachment plate and having pivot means thereon;

an elevation adjustable rod, said adjustable rod having a ball end with bearing means therein and a threaded end with an adjustable nut thereon, said adjustable nut rotatably attached to said supporting frame;

a pair of brackets, said pair of brackets being fixedly attached to said dish attachment plate and being positioned symmetrically about vertical center line, said pair of brackets having pivot means thereon; and a pair of elevation locking bars, said elevation locking bars being connected to said pivot means of said pair of brackets, said locking bars having a longitudinal channel therein, said supporting frame having pivots means that attach into said longitudinal channel.

3. An antenna mounting apparatus as defined in claim 2 wherein said azimuth control means further comprises:

an azimuth support bracket, said azimuth support bracket fixedly attached to said supporting frame;

a first bracket, said first bracket fixedly attached to said azimuth support bracket and having a horizontal hole therethrough;

an azimuth adjustable rod, said azimuth adjustable rod having a ball end with bearing means therein and a threaded end with an adjustable nut thereon, said adjustable nut rotatably attached in said horizontal hole of said first bracket, said bearing means of said azimuth adjustable rod connected to said supporting frame;

a second bracket, said second bracket fixedly attached to said azimuth support bracket and having pivot means thereon; and an azimuth locking bar, said azimuth locking bar being pivotally connected to said supporting frame, said azimuth locking bar having a channel therein, said pivot means of said second bracket connected into said channel of said azimuth locking bar.

4. An antenna mounting apparatus as defined in claim 3 wherein said supporting frame further comprises:

a lower supporting frame, said lower supporting frame fixedly attached to said azimuth support bracket and to said attachment means, said lower supporting frame having a vertical frame member and a horizontal frame member; and an upper supporting frame, said upper supporting frame being connected by pivot means to said lower supporting frame during adjustment, said upper and said lower supporting frames being fixedly attached during non-adjustment, said upper supporting frame comprising:

a rectangularly shaped box, said box having a partially open top, said box having a left support arm and a right support arm, each of said arms having said pivot means for said elevation locking bars and pivot means for attaching ends of said arms to said brackets of said dish attachment plate; and a control means bracket, said control means bracket fixedly attached to the bottom of said box, said adjustable nut rotatably connected to said control means bracket, said ball end of said azimuth adjustable rod pivotally connected to said control means bracket; and a means for rotatably locking said box to said lower supporting frame.

5. An antenna mounting apparatus, said antenna mounting apparatus comprising:

a dish attachment plate, said dish attachment plate having a central opening therein, said dish attachment plate having at least two brackets thereon;

a feed horn attachment plate, said feed horn attachment plate having a central opening therein, said feed horn attachment plate being attached to said dish attachment plate;

an elevation control means, said elevation control means adjustably connected to said dish attachment plate;

a supporting frame, said supporting frame adjustably connected to said elevation control means and to said dish attachment plate;

an azimuth control means, said azimuth control means, adjustably connected to said supporting frame; and attachment means, said attachment means connected to said supporting frame and to a said stationary object.

6. An antenna mounting apparatus as defined in claim 5 wherein said elevation control means further comprises:

a first bracket, said first bracket fixedly attached to said dish attachment plate and having pivot means thereon;

an elevation adjustable rod, said adjustable rod having a ball end with bearing means therein and a threaded end with an adjustable nut thereon, said adjustable nut rotatably attached to said supporting frame;

a pair of brackets, said pair of brackets being fixedly attached to said dish attachment plate and being positioned symmetrically a about vertical center line, said pair of brackets having pivot means thereon; and a pair of elevation locking bars, said elevation locking bars being connected to said pivot means of said pair of brackets, said locking bars having a longitudinal channel therein, said supporting frame having pivots means that attach into said longitudinal channel.

7. An antenna mounting apparatus as defined in claim 6 wherein said azimuth control means further comprises:

an azimuth support bracket, said azimuth support bracket fixedly attached to said supporting frame;

a first bracket, said first bracket fixedly attached to said azimuth support bracket and having a horizontal hole therethrough;

an azimuth adjustable rod, said azimuth adjustable rod having a ball end with bearing means therein and a threaded end with an adjustable nut thereon, said adjustable nut rotatably attached in said horizontal hole of said first bracket, said bearing means of said azimuth adjustable rod connected to said supporting frame;

a second bracket, said second bracket fixedly attached to said azimuth support bracket and having pivot means thereon; and an azimuth locking bar, said azimuth locking bar being pivotally connected to said supporting frame, said azimuth locking bar having a channel therein, said pivot means of said second bracket connected into said channel of said azimuth locking bar.

8. An antenna mounting apparatus as defined in claim 7. wherein said supporting frame further comprises:

a lower supporting frame, said lower supporting frame fixedly attached to said azimuth support bracket and to said attachment means, said lower supporting frame having a vertical frame member and a horizontal frame member; and an upper supporting frame, said upper supporting frame being connected by pivot means to said lower supporting frame during adjustment, said upper and said lower supporting frames being fixedly attached during non-adjustment, said upper supporting frame comprising:

a rectangularly shaped box, said box having a partially open top, said box having a left support arm and a right support arm, each of said arms having said pivot means for said elevation locking bars and pivot means for attaching ends of said arms to said brackets of said dish attachment plate; and a control means bracket, said control means bracket fixedly attached to the bottom of said box, said elevation adjustable nut rotatably connected to said control means bracket, said ball end of said azimuth adjustable rod pivotally connected to said control means bracket; and a means for rotatably locking said box to said lower supporting frame.

* * * * *